US007182242B2

(12) United States Patent
Cai

(10) Patent No.: US 7,182,242 B2
(45) Date of Patent: Feb. 27, 2007

(54) FOOD CONTAINER FOR USE WITH A BEVERAGE RECEPTACLE

(75) Inventor: Liming Cai, West Chester, PA (US)

(73) Assignee: Dopaco, Inc., Exton, PA (US)

( * ) Notice: Subject to any disclaimer, the term of this patent is extended or adjusted under 35 U.S.C. 154(b) by 0 days.

(21) Appl. No.: 10/742,913

(22) Filed: Dec. 23, 2003

(65) Prior Publication Data

US 2005/0133580 A1 Jun. 23, 2005

(51) Int. Cl.
*B65D 3/24* (2006.01)
*B65D 25/20* (2006.01)

(52) U.S. Cl. ..... 229/400; 220/503; 220/523; 220/705; 220/709; 220/710; 220/729; 229/906; 206/217

(58) Field of Classification Search ..... 229/103.1, 229/400, 906, 906.1; 206/217; 426/115; 215/386, 388; 200/90.4, 90.6, 260, 718, 200/23.83, 503–505, 523, 529, 705, 709, 200/710, 729; 222/567, 569, 570, 571, 574
See application file for complete search history.

(56) References Cited

U.S. PATENT DOCUMENTS 2,328,543 A * 9/1943 Bauman ..... 206/217
2,766,796 A * 10/1956 Tupper ..... 206/217
3,085,710 A * 4/1963 McIlroy ..... 220/711
3,185,341 A * 5/1965 Barbour ..... 220/260
3,288,344 A * 11/1966 Woollen et al. ..... 229/103.1
3,323,706 A * 6/1967 Gereke ..... 206/217
3,910,414 A * 10/1975 McCay ..... 220/268
4,009,805 A * 3/1977 Klygis et al. ..... 222/567
4,717,037 A * 1/1988 van der Meulen ..... 220/703
5,180,079 A 1/1993 Jeng
5,464,150 A 11/1995 Porres Sanchez et al.
5,573,131 A * 11/1996 Berjis ..... 220/505
D376,311 S 12/1996 Burton
5,725,117 A 3/1998 Berjis
5,775,570 A 7/1998 Kim
D397,911 S 9/1998 Waldmann
5,875,957 A 3/1999 Yocum
6,119,930 A 9/2000 Lunstra et al.
6,338,417 B1 1/2002 Ferraro
6,382,449 B1 * 5/2002 Kazmierski et al. ..... 229/400
6,427,864 B1 8/2002 Asselin
6,471,119 B2 10/2002 Cai
6,474,494 B1 * 11/2002 Miller ..... 206/217
6,706,297 B1 * 3/2004 Toth et al. ..... 220/710

* cited by examiner

*Primary Examiner*—Gary E. Elkins
(74) *Attorney, Agent, or Firm*—Dennison, Schultz & MacDonald

(57) ABSTRACT

A food container includes an upper portion having a generally frusto-conicle upwardly tapered food containing portion which is adapted to be superimposed on a cover of a beverage container with the cover serving as a base. The food container also includes an integral lower portion for encircling a beverage container below its cover and wherein the upper portion includes a cover engaging portion which extends over only a portion of the cover.

6 Claims, 6 Drawing Sheets

FOOD CONTAINER FOR USE WITH A BEVERAGE RECEPTACLE

FIELD OF THE INVENTION

This invention relates to a food container for use with a beverage receptacle and more particularly to a food container having an upper food containing portion and a lower portion for encircling a top portion of a beverage receptacle.

BACKGROUND FOR THE INVENTION

Snack foods are sold at many establishments such as fast food outlets, carrier outs, movie theaters, concert halls, stadiums, amusement parks, etc. At many such establishments, individuals purchase food items such as french fries, pretzels, popcorn, potato chips and the like. These individuals also purchase liquid refreshments such as soda, lemonade, ice tea, etc. The problem is that an individual only has two hands and with little or no opportunity to sit at a table or stand at a counter, it is often difficult to hold one container in each hand or balance both containers in a single hand and to use the other hand for eating.

The above problem is exacerbated at carry outs where an individual must carry multiple items, open doors, open and shut car doors, and the like. In movies, theaters, sports stadiums and the like there is frequently inadequate space to use as a table or counter top which may result in spilling portions and at times most of the food and beverage. In many of the aforementioned establishments, disposable trays are provided and yet such trays are not a substitute for a table or counter top and may provide an additional problem of picking up and disposing of the trays.

In an effort to overcome the above mentioned problems, food containers for use with beverage receptacles have been developed. For example, the U.S. Pat. No. 5,725,117 of Berjis disclose an apparatus for forming a container to hold a drinking cup at the bottom end of the container and to hold food in an upper portion of the container. As described therein, a unitary container to hold a drinking cup at a bottom end of the container and to hold food in an upper portion of the container is provided. The container is generally a frusto-conical shaped structure such that an individual can have one hand to feed themselves and the other to hold the container which retains the drinking cup and the food.

A more recent patent U.S. Pat. No. 6,338,417 of Ferraro discloses a food container having a side wall and a bottom wall in which there is a cut or opening to allow the passage of a drinking straw through the food container and into a drink receptacle. In such containers, a bottom wall is provided with a plurality of connectors for allowing connection of the food container to receptacles of different sizes at their upper end.

Such containers are particularly useful for fast food restaurants, food stands, movie theaters, concert halls and stadiums which may have little or no space for tables, counter tops or other flat surfaces. Such containers are also particularly applicable for carry out services for use in an automobile, by bicyclist, motorcyclist and children.

It is presently believed that there may be a significant demand for an improved food container for use with a beverage receptacle in accordance with the present invention. It is believed that there is a commercial demand because such containers can be shipped flat and opened up into a food containing portion and a receptacle encircling portion, position the food above the beverage and at the same time can be manufactured at a competitive costs, stored in a compact form and readily used by the pervayor of food and beverages.

Further advantages of the food containers in accordance with the present invention reside in the use of a cover of a beverage container as a base for the food container eliminating the need for a separate base, a channel in the side wall of the food container and perforations in the cover of the beverage receptacle for accommodating a straw, a higher arch shape back for the food container and a lower arch shape front for access to food. Further, the use of offset fold lines provides a base for the food container which is smaller than the cover of the beverage receptacle. These and other advantages will be readily apparent from the following description of the invention.

BRIEF SUMMARY OF THE INVENTION

In essence, a food container in accordance with the present invention is adapted for use with a covered beverage receptacle. The food container includes an upper portion having a generally conical upwardly tapered food containing portion which is adapted to the superimposed on a cover of a beverage receptacle so that the cover of the beverage receptacle serves as a base or bottom of the food containing portion. The food container in accordance with the invention also includes an integral lower portion for encircling a beverage container below its cover. The upper portion also includes a cover engaging portion which extends over a portion of the cover. In other words, the bottom of the food containing portion that rests on the cover is smaller than the cover in order to prevent the food contained therein from falling out of the bottom of the food containing portion.

The present invention also contemplates the combination of a beverage receptacle and a food container. In this embodiment of the invention, a beverage receptacle includes a frusto-conical shaped body with an upwardly tapered side wall, an open top having a lip formed around its periphery and a bottom in sealing engagement with a lower portion of the upwardly tapered conical shape. A lid or cover has a downwardly extending wall portion which is constructed and arranged to snap over the lip and fit snugly thereon. The combination also includes a generally frusto-conical upwardly tapered food containing portion which is positioned on the cover so that the cover forms a base or bottom of the food containing portion. The food container also includes a lower receptacle engaging portion for encircling the beverage receptacle below the cover and preferably has a frusto-conical shape with an upwardly tapered body that has the same or approximately the same taper as the beverage receptacle. The receptacle engaging portion is also slightly smaller in dimension then the top of the receptacle and is preferably constructed and arranged to have a close fit under the lip of the beverage receptacle to provide a more stable combination.

The invention will now be described in connection with the accompanying drawings wherein like reference numerals have been used to designate like parts.

DETAILED DESCRIPTION OF THE PREFERRED EMBODIMENTS OF THE INVENTION

Figure 1:
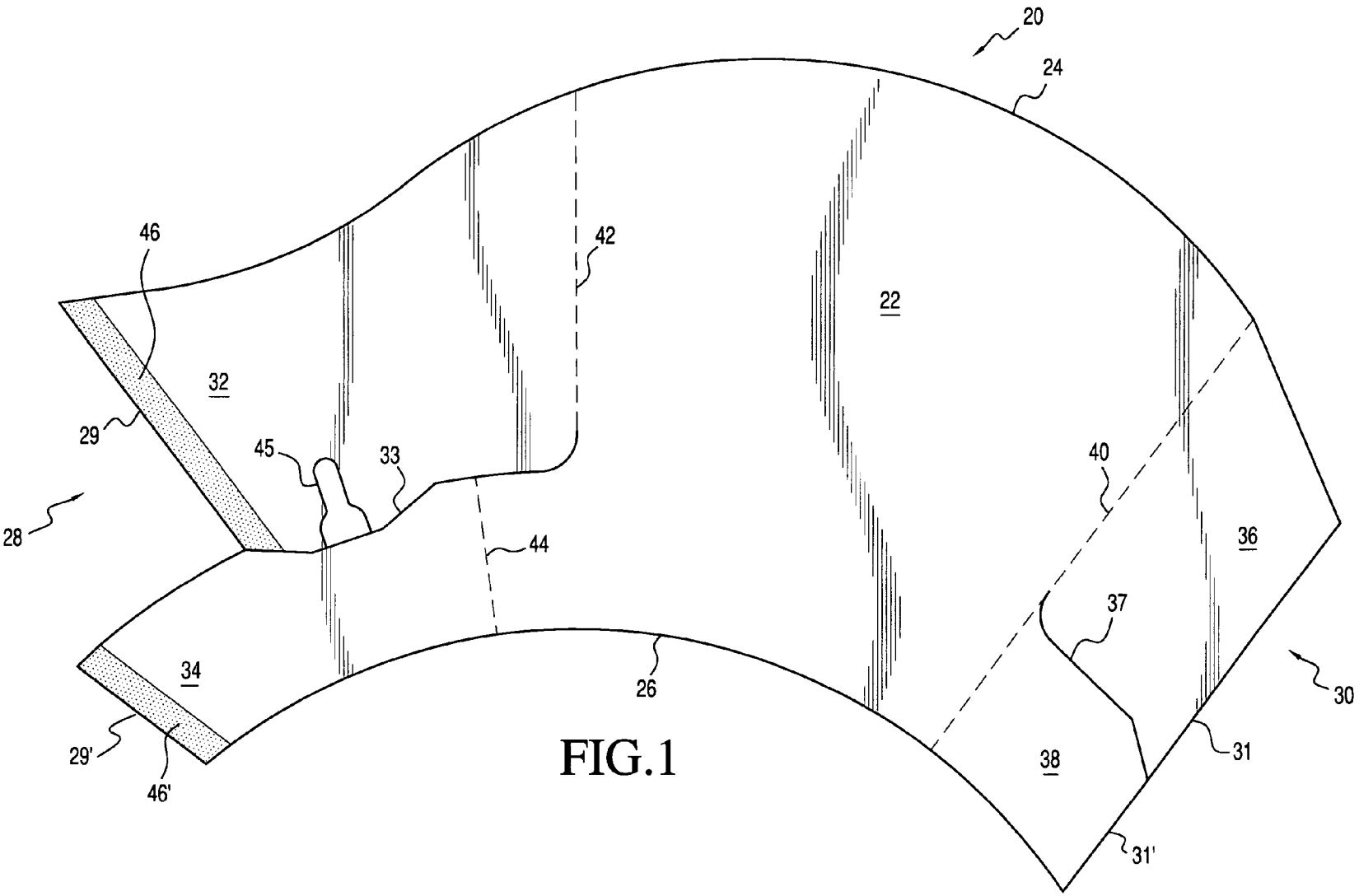
FIG. 1 is a top or plain view of a one piece carton blank for use in forming a food container in accordance with the present invention.
Figure 4:
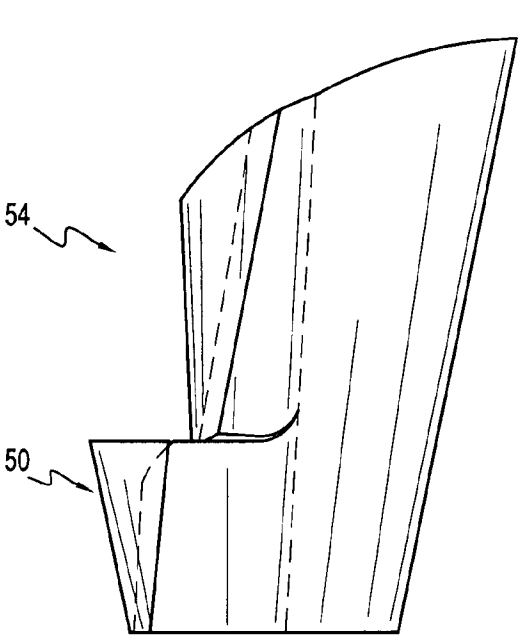
FIG. 4 is a side elevational view of the food container shown in FIGS. 2 and 3.
Figure 3:
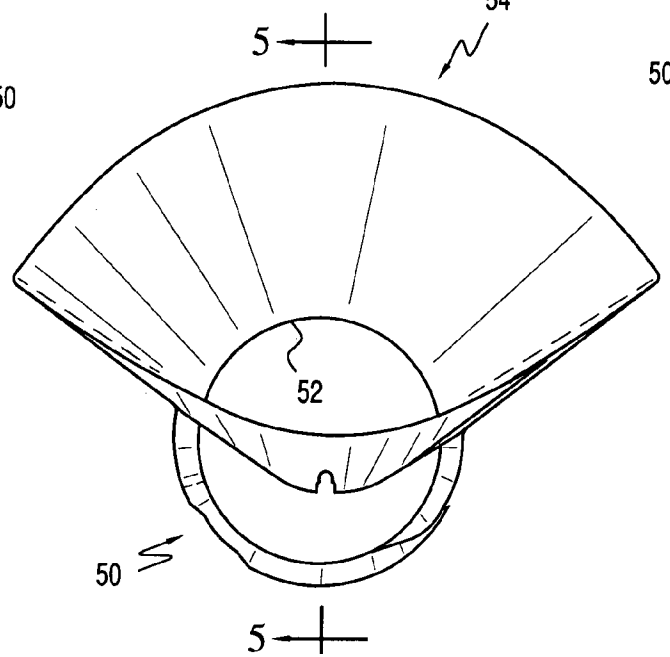
FIG. 3 is a top view of the food container shown in FIG. 2.
Figure 2:
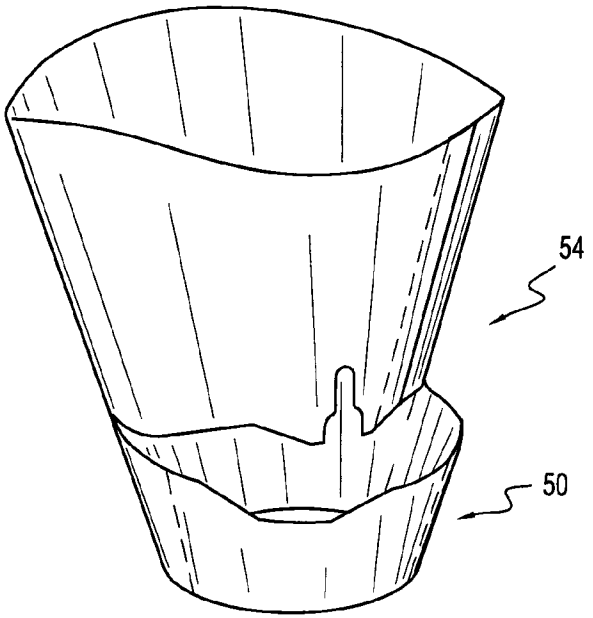
FIG. 2 is a perspective view illustrating a formed carton in accordance with the invention.

As illustrated in FIG. 1, a one piece carton structure 20 is made of a stiff resilient and flexible sheet material which is adapted to be folded flat and subsequently formed into a food container for use with a covered beverage receptacle (not shown in FIG. 1). The carton structure comprises a planar sheet 22 of material having a top 24, a bottom 26 and sides 28 and 30. The sides 28 and 30 include outer edges 29, 29' and 31, 31' respectively. The sides 28 and 30 are each separated into upper and lower sections. For example, the side 28 includes upper and lower sections 32 and 34 respectively while the side 30 includes upper and lower sections 36 and 38 respectively. The upper and lower sections 32 and 34 are separated from one another by a cut 33 while the upper and lower sections 36 and 38 are separated by a cut 37. As shown in FIG. 1, the carton structure 20 also includes three converging fold lines 40, 42 and 44 which converge from the top 24 of the structure 20 toward the bottom 26 which are effective in forming the frusto-conical shapes of the final structure.

The side 28 also includes a glue portion 46 and 46' adjacent to the edges 29 and 29' respectively. The glue portions 46 and 46' are glued to the sides 36 and 38. Also, because of the offset of the fold line 44 from the fold line 42, the receptacle encircling portion 50 (FIGS. 2–6) is larger than an opening 52 defined by the food containing portion 54.

As shown in FIG. 1, a channel 45 or opening is defined by the upper section 32 of side 28 which allows a straw 47 to extend through the side 28 of the food containing portion while opening the upper section 32.

Figure 5:
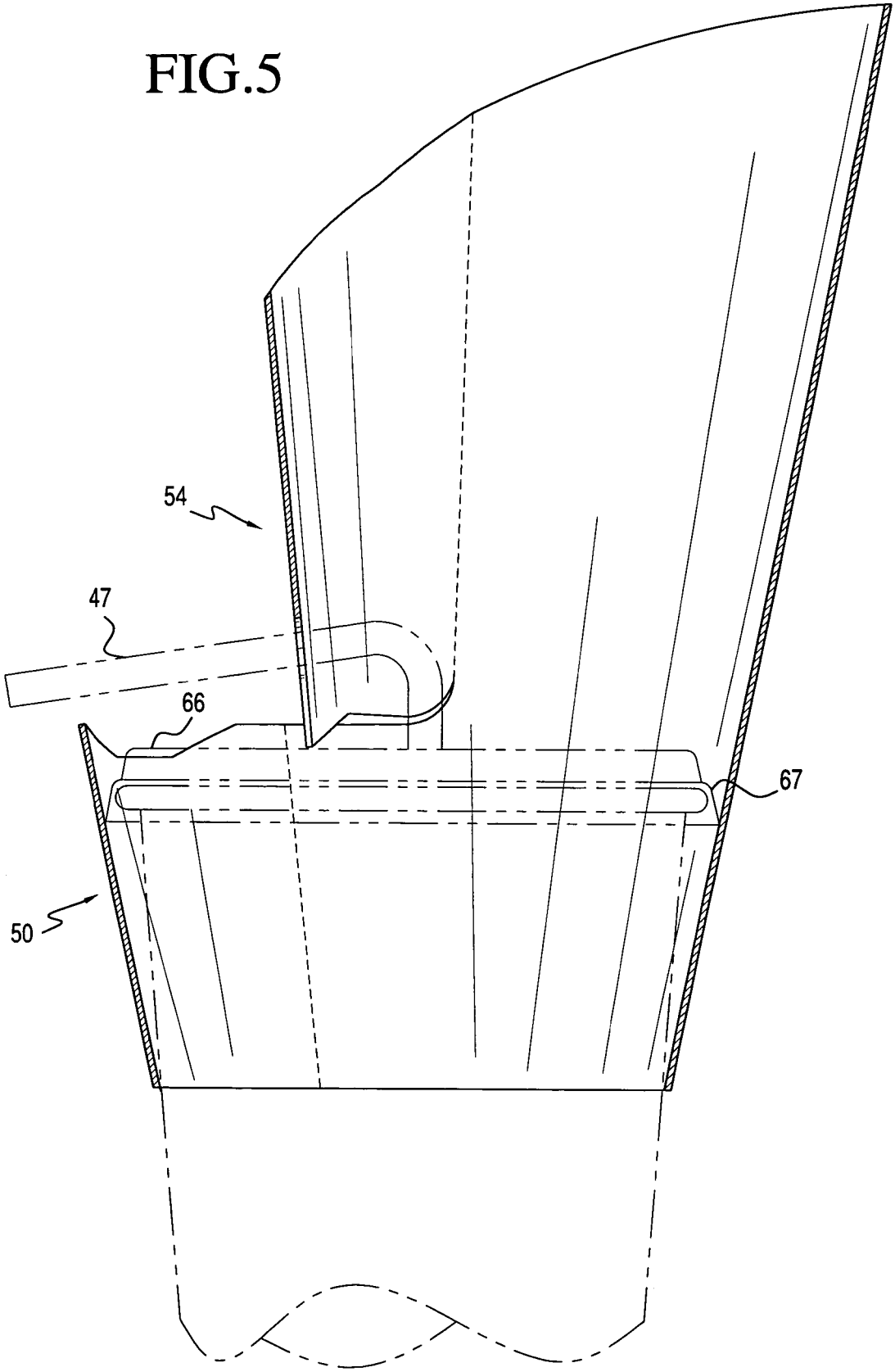
FIG. 5 is a side elevation view of a food container, beverage receptacle and straw in accordance with the present invention.
Figure 6:
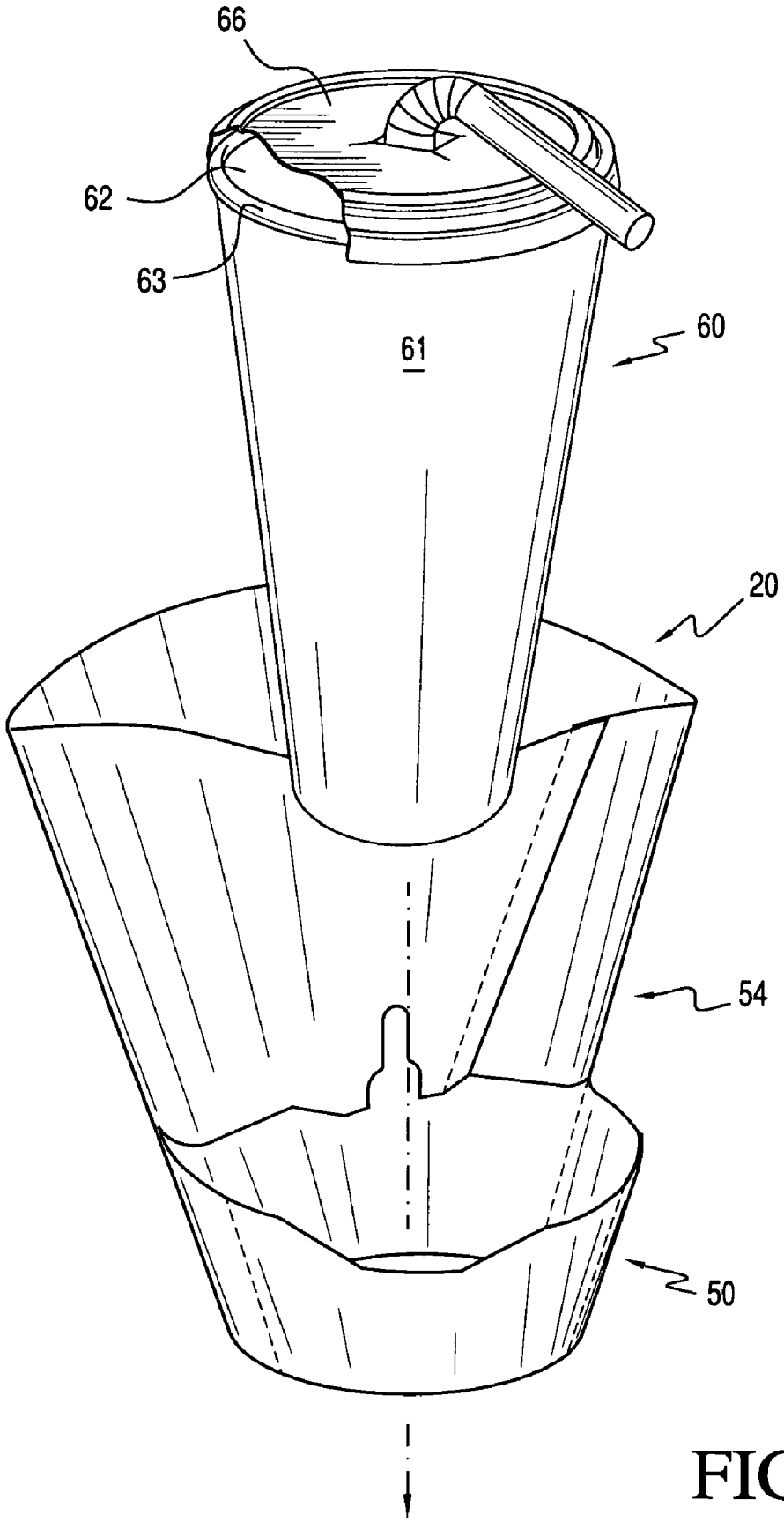
FIG. 6 is a partially exploded perspective view which illustrates the assembly of a food container and beverage receptacle in accordance with the present invention.
Figure 7:
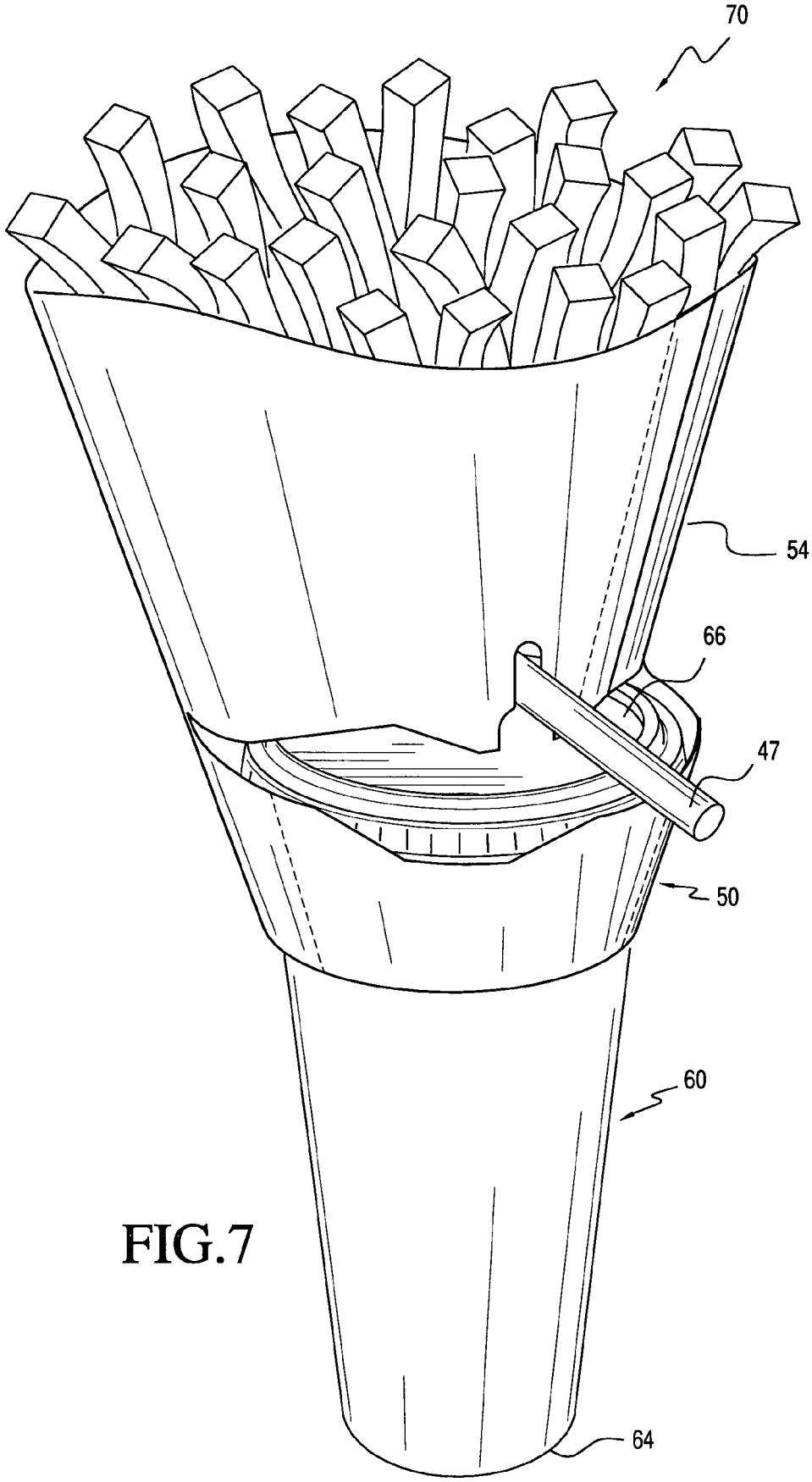
FIG. 7 is a perspective view of a food container and beverage receptacle in accordance with the present invention; and, FIG. 8 is an elevational view of a food container as folded flat for shipping.
Figure 8:
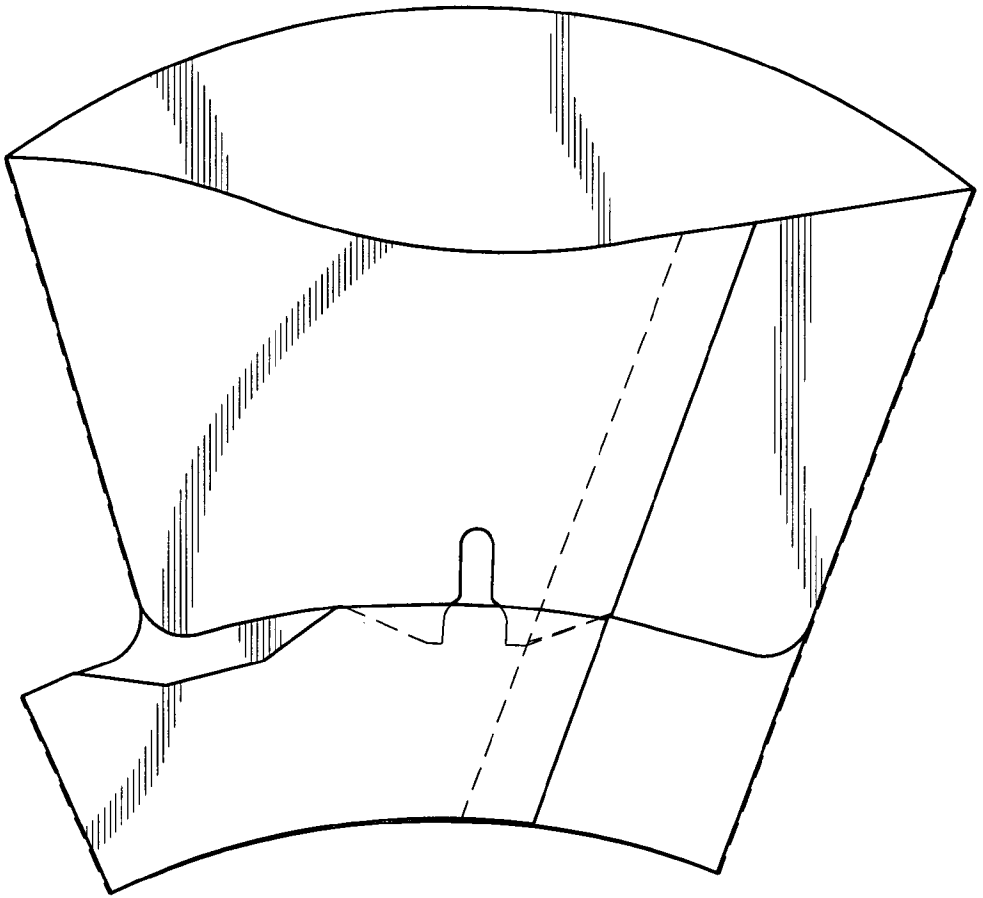

A combination of a food container 20 and beverage receptacle 60 is illustrated in FIGS. 5, 6 and 7. As shown therein, the beverage receptacle defines a generally frusto-conical shaped body 61 for containing a drink with an open top 62 having an upper lip 63 formed around its periphery in a conventional manner. The beverage receptacle is of a conventional material for drinking cups as will be well understood by persons of ordinary skill in the art. The receptacle 60 also includes a bottom 64 in sealing engagement with a frusto-conical shaped body. A cover 66 includes a downwardly extending wall 67 which fits or snaps over the open top of the receptacle 60 to form a base for the food containing portion 54 and separates the food 70 such as french fries from a beverage in the receptacle 60. Also, the food containing portion 54 prevents the cover 66 from popping open if the receptacle 60 is squeezed too hard or the receptacle 60 is dropped on the floor. As illustrated, the straw 47 extends through the cover 66 into the beverage 60 and outward through the channel 45 in the food containing portion. It should also be appreciated that the receptacle 60 may be positioned at any angle relative to the receptacle encircling portion 50 while the receptacle encircling portion 50 engages the receptacle 60.

While the invention has been described in connection with its preferred embodiments, changes and modifications may be made therein without departing from the scope of the appended claims.

What is claimed is:

1. A one piece carton structure of stiff resilient and foldable sheet material adapted to be folded flat and formed into a food container for use with a covered beverage receptacle, said carton structure comprises a planar sheet of material having a top, a bottom, first and second sides, each having an outer edge, and a plurality of converging fold lines which converge from the top toward the bottom of said planar sheet, and a first of said converging fold lines connecting said top and said bottom of said planar sheet to thereby form a first panel, said top and said outer edge of said first side, and said bottom together with a first cut extending between said outer edge of said first side and together with said first fold line separate said panel into a first upper section and a first lower section;

a second and a third of said plurality of converging fold lines offset from one another and a second cut intermediate of said top and bottom and extending between said second and said third fold lines to thereby form a second upper section and a second lower section, said second upper section including an open channel and said outer edge of said second side forming outer edges of said second upper and said second lower sections with the outer edge of said second lower section being outwardly displaced from said outer edge of said second upper section and wherein said second upper section is fixed to said first upper section of said first panel to thereby form a food containing portion and wherein said second lower section is fixed to said first lower section of said first panel to thereby form a cup encircling and engaging portion.

2. A one piece carton structure of stiff resilient and foldable sheet material adapted to be folded flat and formed into a food container which can be superimposed on a covered beverage receptacle according to claim 1 in which said second upper section and said second lower section are fixed to said upper and lower sections of said first panel by adhesive bonding.

3. A one piece carton structure of stiff resilient and foldable sheet material adapted to be folded flat and formed into a food container which can be superimposed on a covered beverage receptacle according to claim 2 in which said top and said bottom of said planar sheet each define an arch shaped portion with the top of the arches toward the top of the container structure.

4. A one piece carton structure of stiff resilient and foldable sheet material adapted to be folded flat and formed into a food container which can be superimposed on a covered beverage receptacle according to claim 3 in which the top of said planar sheet defines an undulating or scalloped shape.

5. A one piece carton structure of stiff resilient and foldable sheet material adapted to be folded flat and formed into a food container which can be superimposed on a covered beverage receptacle according to claim 4 in which said outer edge of said first and second sides converge from the top to the bottom of said planar sheet.

6. A one piece carton structure of stiff resilient and foldable sheet material adapted to be folded flat and formed into a food container which can be superimposed on a covered beverage receptacle according to claim 5 in which said opening in said second panel is a channel.

* * * * *